United States Patent [19]

Schmiedgen et al.

[11] Patent Number: 4,523,350

[45] Date of Patent: Jun. 18, 1985

[54] CARDER FOR MANUFACTURING NON-WOVEN, FORMED FABRIC FROM FIBROUS SUBSTANCES

[75] Inventors: Hans Schmiedgen; Siegfried Bernhardt; Otto Strobl; Dietrich Menzel, all of Bremen, Fed. Rep. of Germany

[73] Assignee: Spinnbau GmbH, Fed. Rep. of Germany

[21] Appl. No.: 508,876

[22] Filed: Jun. 28, 1983

[30] Foreign Application Priority Data

Jun. 29, 1982 [DE] Fed. Rep. of Germany ..... 3224118

[51] Int. Cl.[3] ..... D01G 15/40

[52] U.S. Cl. ..... 19/98; 19/105; 19/106 R; 19/296; 19/300

[58] Field of Search ..... 19/98, 106 P, 105, 296, 19/145.7, 300, 65 CR

[56] References Cited

U.S. PATENT DOCUMENTS 4,128,917 12/1978 Varga ..... 19/98 X

FOREIGN PATENT DOCUMENTS 0236259 10/1964 Austria .
0704381 3/1941 Fed. Rep. of Germany .
2343064 3/1975 Fed. Rep. of Germany .

OTHER PUBLICATIONS

"Melliand Textilberichte", 6/1969, pp. 625–630.
Schlese Article in "Chemiefasern", No. 11/1969, pp. 3–11.

*Primary Examiner*—Louis K. Rimrodt
*Attorney, Agent, or Firm*—Hill, Van Santen, Steadman & Simpson

[57] ABSTRACT

Carder for manufacturing non-woven formed fabric from fibrous substances comprising a plurality of principal rollers and workers and clearers working with said principal rollers, comprising a draw-in roller (1) and a licker-in (2) running in the same direction and with high drawing, comprising a first principal roller (3) running in a direction opposite the licker-in (2) and with low drawing, comprising at least one pair of rollers consisting of a worker (4) and a clearer (5) cooperating with said first principal roller (3), and comprising a first matting roller (8) running in the same direction as said first principal roller (3) and with low crushing or with low drawing, whereby the draw-in roller (1), the licker-in (2), the principal rollers (3, 9), the matting rollers (8, 12), the doffing cylinders (13, 18) and the second crushing cylinders (15, 20) are driven by respectively separate, independently controllable motors such that a change of the speed of the principal roller (3) effects a change of the speed of all other rollers (FIG. 1).

5 Claims, 4 Drawing Figures

CARDER FOR MANUFACTURING NON-WOVEN, FORMED FABRIC FROM FIBROUS SUBSTANCES

Figure 1:
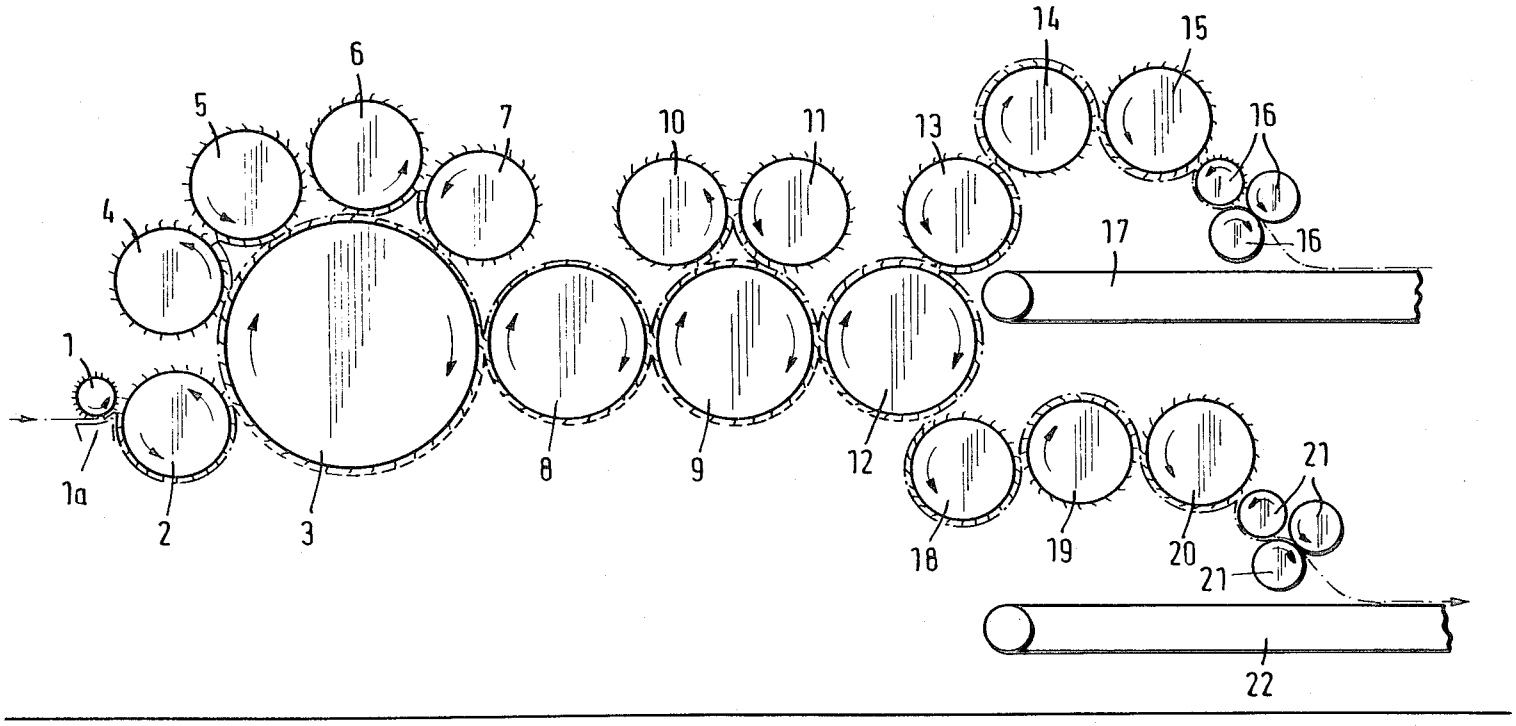

The invention relates to a carder for manufacturing non-woven, formed fabric from fibrous substances comprising at least one principal drum and comprising workers and clearers cooperating with the principal drum or, respectively, the principal drums.

Carders serve the purpose of disentangling fiber flocks into their individual fibers and placing these parallel. Thus, a faultless fibrous web is to be produced from random flock material.

A carder of the species type is known from the German OS No. 23 43 064. Given this carder, the flock material is supplied to a porcupine opener running with low circumferential speed over draw-in roller pairs disposed behind one another. The material is then supplied to a successive series of further rollers respectively running in alternating rotational senses. The drawing of these rollers (the ratio of the speed of the feeder roller to the speed of the calender roller) thereby lies relatively high so that the last of the rollers reaches the required high speed. Workers are allocated to the individual rollers; the material is carded at the points of contact between said workers and the principal drums.

This known carder has the disadvantage that the manufacture of a faultless card web is not guaranteed. In particular, this is frequently not sufficiently uniform; further, the cross-stiffness does not meet all demands. Further, this carder is lacking the desired adjustability with regard to the flock material to be processed.

The object of the invention is to create a carder for overcoming the said disadvantages which produces a faultless, uniform card web which exhibits the required cross-stiffness. Attainment of this object should be guaranteed independently of the type of fiber to be processed.

This object is inventively resolved by means of a draw-in roller and a licker-in running in the same direction with said draw-in roller and with high drawing, a first principal roller running in a direction opposite that of the licker-in and with low drawing, at least one pair of rollers cooperating with said first principal roller and consisting of a worker and of a clearer, and of a first matting roller running in the same direction as the first principal roller and with low crushing or with low drawing.

One or more further, following assemblies consisting of a second principal drum, a worker, a clearer and of a second matting roller preferably follow. Further, one or more doffing cylinders working with the last of the matting rollers and running in a direction opposite thereto, one or, respectively, one respective first crusher cylinder running in a direction opposite the doffing cylinder or doffing cylinders, one or, respectively, one respective second crusher cylinder running in a direction opposite the first crusher cylinder or, respectively, the first crusher cylinders and cooperating therewith and a three-roller takedown or, respectively, a respective three-roller takedown cooperating with the second crusher cylinder or, respectively, the second crusher cylinders can be provided.

A device for disengaging the crusher cylinder or, respectively, the crusher cylinders such that the three-roller takedown or, respectively, the three-roller takedowns directly cooperate with the doffing cylinder or, respectively, the doffing cylinders is preferably provided.

The drawing between draw-in roller and the licker-in can amount to between 100 and 200; a value of approximately 150 is preferred. In contrast thereto, the drawing between licker-in and first principal roller or, respectively, principal rollers and the matting roller or, respectively, the matting rollers lies between 1 and 2, whereby the range of approximately 1.1 is preferred here.

Given one embodiment, the workers are disposed in front of the appertaining clearers. Workers and clearers can, in particular, exhibit diameters of the same size.

For the purpose of better controllability of the draw-in roller, the licker-in, the principal rollers, the matting rollers, the doffing cylinders and the second matting rollers, respectively separate, independently controllable motors (M1, M3, M4, M5, M6, M8, M9, M10, M12, M13, M15, M18, M20) can be provided. The motors can thereby be wired such that a change of the speed of the first principal roller effects a change of the speed of all other rollers. A change of the speed of the second principal roller can also effect a change of the speed of the appertaining worker and of the second matting roller. Analogously applying in terms of effect is a change of the speed of the lower doffing cylinder for the change of the speed of the draw-in roller, of the second, lower crusher cylinder and of the upper doffing cylinder, as well as for a change of the speed of the upper doffing cylinder for the change of the speed of the second, upper crusher cylinder.

This dependence is achieved in a particularly reliable manner by means of tachometer generators at the motors (M1, M3, M4, M5, M6, M8, M9, M10, M12, M13, M15, M18, M20).

Figure 2:
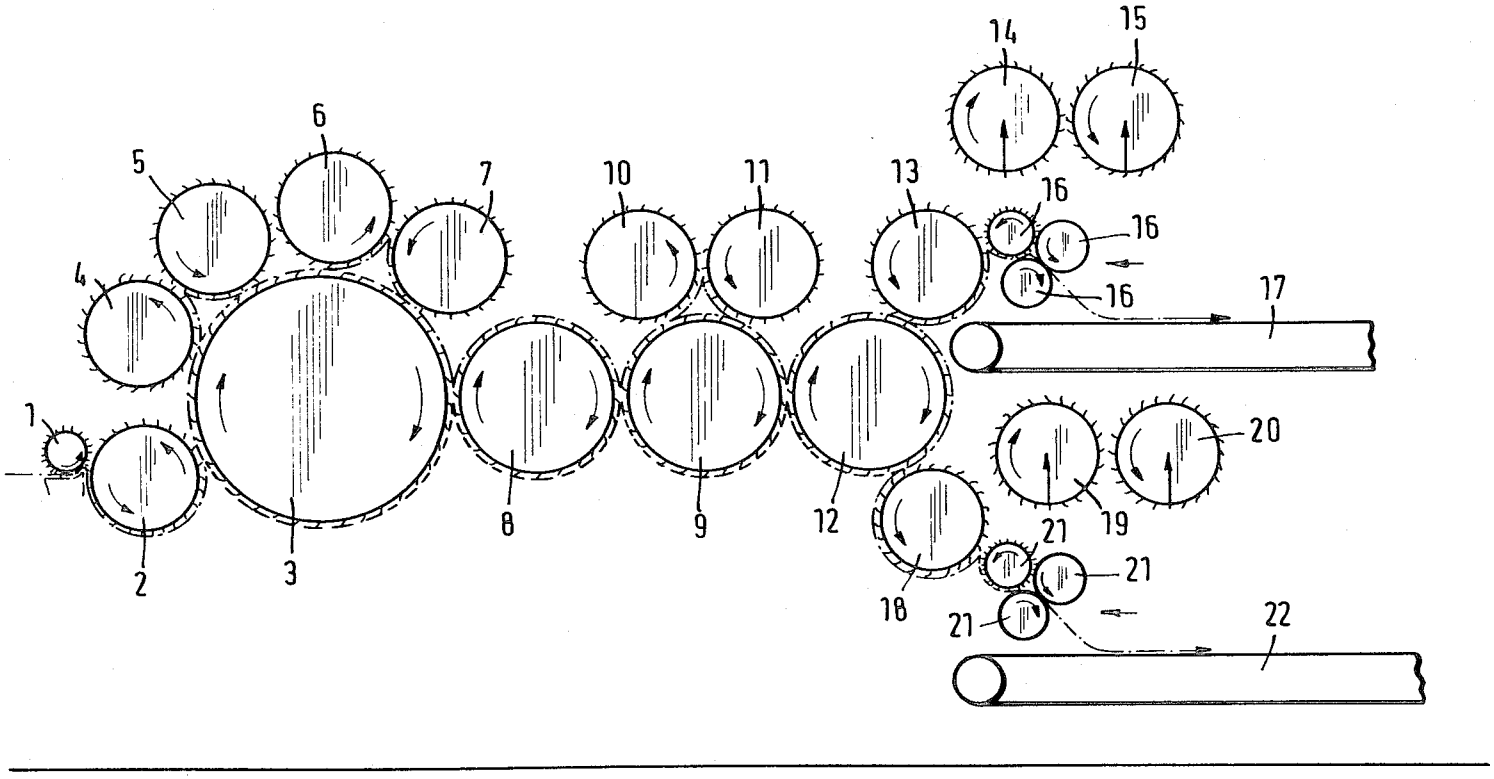
Figure 3:
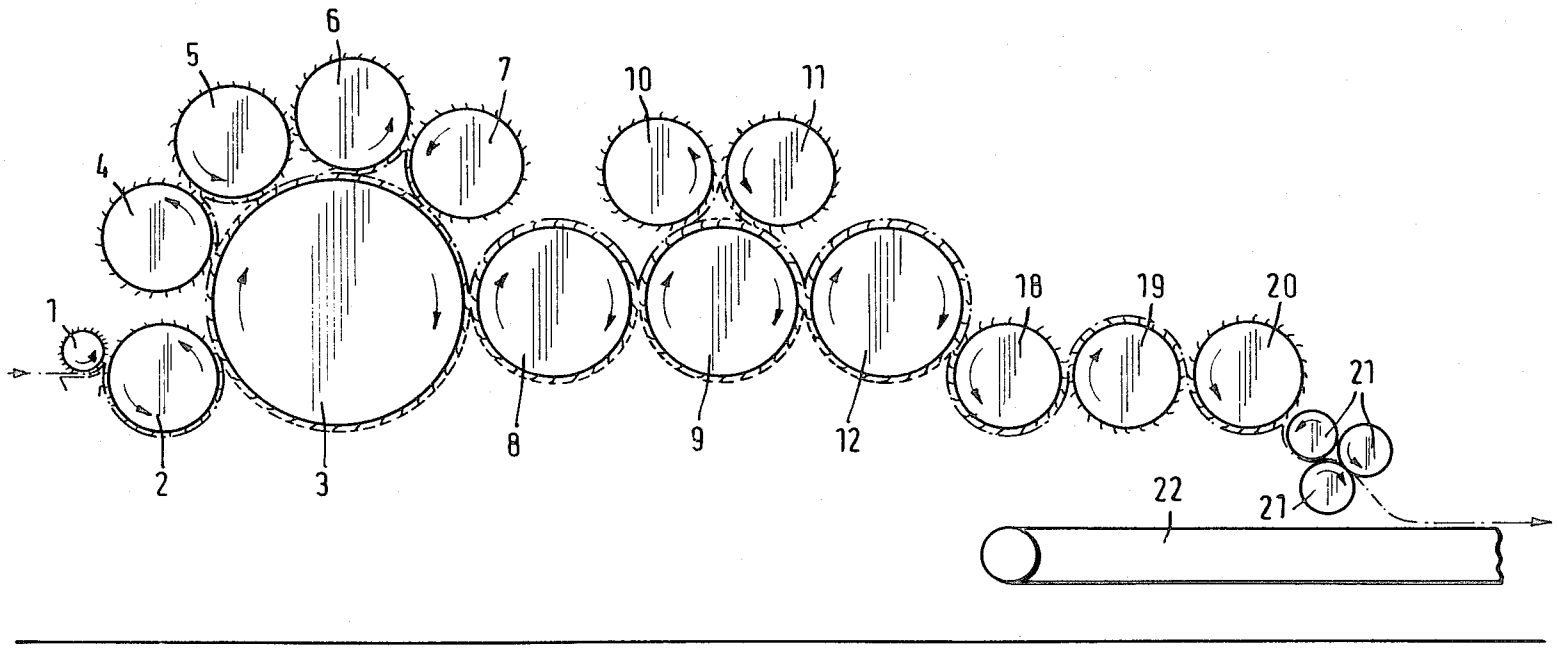
Figure 4:
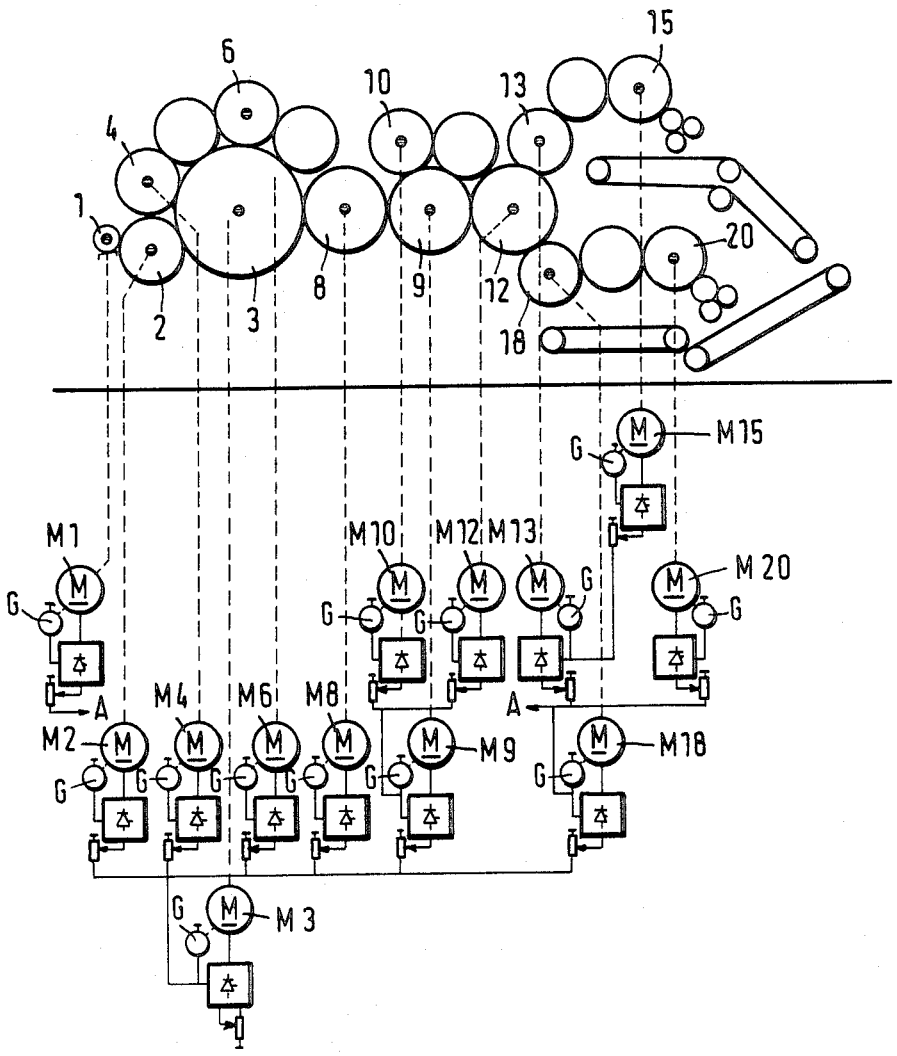

Further features and advantages of the invention derive from the claims, the specification and the following drawing. Thereby shown are:

FIG. 1 a schematic illustration of the disposition of the rollers of the inventive carder;

FIG. 2 a disposition of the rollers of the inventive carder given disengaged crusher cylinders;

FIG. 3 an illustration of the inventive arrangement having only one doffing cylinder and only one pair of crusher cylinders;

FIG. 4 a schematic illustration of the dependencies of the motor regulations.

FIG. 1 illustrates how the fiber material (dot-dash line) in a draw-in bottom box under the draw-in roller 1 which is provided with radially disposed hooks is supplied to the licker-in 2. The licker-in 2 is equipped with metallic card teeth aligned inclined in the rotational direction; said licker-in 2 rotates in the opposite direction relative to the draw-in roller 1. The fiber material is supplied to the first principal roller 3 which runs in a direction opposite that of the licker-in 2 and is equipped with metallic card teeth directed in the sense of rotation. The fiber material is then conveyed on the circumference of the first principal roller to the worker 4 which runs in a direction opposite that of the first principal roller and which is provided with metallic card teeth directed opposite the rotational sense of said worker. The fiber material is then taken over by a clearer 5 which runs in a direction opposite that of the worker 4 and which is equipped with saw-tooth filetting directed in the opposite direction. From this clearer 5, the fiber material is resupplied to the first principal roller 3 until a further worker and clearer pair 6, 7 effects a renewed carding and re-transfer. The fiber material is then transferred from the first principal roller 3 to a first matting roller 8 which runs in the same direction as the first principal roller 3 and is provided with a saw-tooth filetting directed in the rotational direction. From said first matting roller 8, the fiber material is then supplied to a second principal roller 9 corresponding to the first principal roller 3 which, in the sample embodiment, cooperates with only one worker/clearer pair 10, 11 and then transfers the fiber material to a second matting roller 12 corresponding to the first matting roller 8. From said second matting roller 12, the material is supplied to an upper and to a lower doffing cylinder 13, 18 which run in a direction opposite that of the second matting roller 12 and which are equipped with saw-tooth filetting directed opposite their sense of rotation. From these doffing cylinders 13, 18, the non-woven, formed fabric is supplied to first crushing cylinders 14 and 19 as well as to second crushing cylinders 15 and 20, whereby the successive doffing cylinders 13, 20 and crushing cylinders 14, 15, 19, 20 respectively run in directions opposite one another. The saw-tooth filetting of the doffing cylinders and crushing cylinders 13, 14, 15, 18, 19, 20 is respectively directed opposite their sense of rotation. The non-woven, formed fabric is finally conducted out of the carder over three-roller takedowns 16, 21. FIG. 2 largely corresponds to FIG. 1 with the sole modification that the crusher cylinders 14, 15, 19, 20 are disengaged. Given the sample embodiment of FIG. 3, only one doffing cylinder, a first crushing cylinder and a second crushing cylinder as well as one three-roller takedown are provided.

The inventive disposition of the rollers enables work to be carried out between the licker-in and draw-in roller with relatively high drawing - it amounts to 150 in the sample embodiment. Tests have shown that the fiber flocks can be gently disentangled given such high drawing. As a result of the relatively high speed even of the licker-in 2, the drawing between the principal and matting rollers 3, 8, 9, 12 can be kept low, namely, in the range of only slightly over 1. Low crushing between the principal and matting rollers 3, 8, 12 is also possible. Such a low drawing or, respectively, low crushing effects a gentle transfer of the fiber material from drum to drum. Despite only slight speed differentials between principal and matting rollers 3, 8, 9, 12, a good carding effect is thereby achieved as a result of neighboring drums running in opposite directions. The opposed working of neighboring drums thereby particularly effects that a high cross-closeness of the non-woven, formed fabric to be manufactured is achieved.

The topping of the appertaining worker 4, 6, 10 relative to the appertaining clearer 5, 7, 11 and the equal diameters of the two drums effects that the fibers remain in the proximity area of the principal drum and relatively slight fly fiber occurs above the workers and clearers. Shown on the basis of a broken line in FIGS. 1, 2, 3 is how insufficiently carded material is returned from the matting roller 12 to the first principal roller 1 over the second principal roller 9, the first matting roller 8, so that said material can again be carded between the principal rollers and the workers and can be carried in the flow direction.

It is self-understood that the spacing of the drums relative to one another can be respectively adjusted given the inventive arrangement.

The speeds of the various drums can be achieved in the standard manner over only one or two motors and the required chains or drive belts. An embodiment wherein a respectively separate motor is allocated to the drums is, however, advantageous. FIG. 4 illustrates a corresponding arrangement. It is thereby shown that, as a result of a corresponding wiring of the motors, a change of the speed of the principal roller effects a change of the speed of all other motors and, thus, of the appertaining drums. Corresponding dependencies derive for the motors M10 and M12 relative to the motor M9, the motors M1, M13 and M20 relative to the motor M18, and the motor M15 relative to the motor M13. Of course, the motors can also be adjusted independently of one another; the dependency shown in the sample embodiment of FIG. 4, however, simplifies the control of various motor speeds. The requirements of different flock material and the desired quality of the non-woven, formed fabric can be taken into consideration based on an adaptation of the spacings of the drums relative to one another and of the speed of the drums relative to one another.

The features of the invention disclosed in the above specification, the drawings and in the claims can be essential to the realization of the invention in its various embodiments both individually as well as in random combinations.

We claim:

1. In an improved carder for fleece manufacture from fibrous material comprising at least one draw-in roller, a licker-in roller running oppositely to said draw-in roller, at least one master roller, and including worker roller means and clearer roller means cooperating therewith, the improvement wherein each master roller is followed by a fleece matting means, each fleece matting means comprising a matting roller means running in the same direction as the associated said master roller, said matting roller means producing a fleece drawing between 1 and 2 times compared to the associated said master roller a fleece draw-in depression cooperatively formed with said draw-in roller, whereby a fleece drawing of from about 100 and 200 times is provided between said draw-in roller and said licker-in roller with said licker-in roller running in the same direction; and a fleece drawing of from about 1 to 2 times exists between said licker-in roller and said associated master roller.

2. The carder of claim 1 which includes at least one clearer roller means acting with the last of the matting roller means and running oppositely thereto, a first crusher drum means running oppositely to said clearer roller means, a second crusher drum means running oppositely to said first crusher drum means and cooperating therewith, and a three-roller takedown means cooperating with said second crusher drum means.

3. The carder of claim 2 wherein in said fleece drawing between said draw-in roller and said licker-in roller amounts to about 150 times.

4. The carder of claim 2 wherein said fleece drawing between said licker-in roller and said associated master roller, and between said master roller and said matting roller means, amounts to about 1.1. times.

5. The carder of claim 2 wherein said worker roller means and said clearer roller means have identical diameters.

* * * * *